US007496314B2

(12) United States Patent
Lombardo et al.

(10) Patent No.: US 7,496,314 B2
(45) Date of Patent: Feb. 24, 2009

(54) CUSTOMER REPLACEABLE UNIT ASSEMBLY

(75) Inventors: John F Lombardo, Woodbridge (CA); Salvatore J Provvidenza, Ajax (CA)

(73) Assignee: Xerox Corporation, Norwalk, CT (US)

( * ) Notice: Subject to any disclaimer, the term of this patent is extended or adjusted under 35 U.S.C. 154(b) by 99 days.

(21) Appl. No.: 11/565,936

(22) Filed: Dec. 1, 2006

(65) Prior Publication Data

US 2008/0131163 A1 Jun. 5, 2008

(51) Int. Cl.
*G03G 15/00* (2006.01)
*G03G 21/16* (2006.01)

(52) U.S. Cl. ..... 399/110; 399/107; 399/111

(58) Field of Classification Search ..... 399/107, 399/110, 111, 122, 361, 365, 381, 411
See application file for complete search history.

(56) References Cited

U.S. PATENT DOCUMENTS 6,643,480 B2 * 11/2003 Kuwata et al. ..... 399/107
6,819,895 B2 * 11/2004 Suzuki ..... 399/122
7,072,603 B2 * 7/2006 Tsuzuki et al. ..... 399/111
7,319,833 B1 * 1/2008 Miller ..... 399/111
2003/0185587 A1 * 10/2003 Kawai et al. ..... 399/111

* cited by examiner

*Primary Examiner*—Sandra L Brase
(74) *Attorney, Agent, or Firm*—Tallam I. Nguti

(57) ABSTRACT

A customer replaceable unit (CRU) assembly for mounting in a sheet handling machine is disclosed and includes (a) a CRU frame having a frame size for fitting into a mounting portion within the sheet handling machine; (b) a first roller assembled rotatably to the CRU frame; (c) a second roller assembled rotatably to the CRU frame and for resilient contact with the first roller to form a sheet handling nip; and (d) a spacer and anti-mounting assembly including (i) a holding feature formed in the CRU frame and (ii) a removable member mounted in the holding feature for temporarily preventing mounting of the CRU frame into the mounting portion within the sheet handling machine, and for temporarily spacing the second roller out of resilient contact with the first roller so as to prevent roller flat spots, operating roller noise, and premature roller failure.

12 Claims, 3 Drawing Sheets

CUSTOMER REPLACEABLE UNIT ASSEMBLY

The present disclosure relates to a customer replaceable unit (CRU) of a sheet handling machine such as an electrostatographic machine, and more particularly concerns a device for preventing undesirable deformations, after assembly, in either roll of a two roll sheet feeding nip assembly for example the retard and feed rolls of a document feeder CRU, during storage and shipping, but before installation of the sheet feeding nip assembly or CRU in the machine.

In a typical electrostatographic printing machine using the xerographic process, a photoconductive member is charged to a substantially uniform potential so as to sensitize the surface thereof. The charged portion of the photoconductive member is exposed to a light image of an original document placed manually on a platen of the machine or automatically fed onto such platen by a document handler of the machine. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member in a timed manner to a copy sheet fed from a sheet supply. The toner powder image on the copy sheet is subsequently heated to permanently affix it to the copy sheet.

In electrostatographic printing machines such as those described above, the components of the document handler for example, which includes a retard roll and a feed roll as components, can be assembled as a CRU or customer replaceable unit that can be replaced by a customer at the end of life or at the premature failure of one or more of the components. The CRU concept integrates various subsystems whose useful lives are predetermined to be generally the same length. The service replacement interval of the CRU insures maximum reliability and greatly minimizes unscheduled maintenance service calls. Utilization of such a strategy, allows customers to participate in the maintenance and service of their copiers/printers. CRUs insure maximum up time of copiers and minimize downtime and service cost due to end of life or premature failures.

In a sheet feeding document handler, for example, a Duplexing Automatic Document Handler or DADH device, the first roller 212 is a retard roll and the second roller 214 is a feed roll as such rolls are well known in the art. When initially assembled, and in order to function properly, the retard roll and feed roll of each DADH/CRU are designed to contact each other in the CRU. It has been found that during initial warehousing and/or through shipping to a customer site for set up and operation, tread lines and/or flat spots are undesirably formed for example on the retard roll in the area of contact between the two rolls. Such tread lines and/or flat-spots are believed to be the cause of early retard roll flat spotting and of roll noise during operation, in either case resulting in premature failure.

In accordance to the present disclosure, a customer replaceable unit (CRU) assembly is provided for mounting in a sheet handling machine and includes (a) a CRU frame having a frame size for fitting into a mounting portion within the sheet handling machine; (b) a first roller assembled rotatably to the CRU frame; (c) a second roller assembled rotatably to the CRU frame and for resilient contact with the first roller to form a sheet handling nip; and (d) a spacer and anti-mounting assembly including (i) a holding means formed in the CRU frame and (ii) a removable member mounted in the holding means for temporarily preventing mounting of the CRU frame into the mounting portion within the sheet handling machine, and for temporarily spacing the second roller out of resilient contact with the first roller so as to prevent roller flat spots, operating roller noise, and premature roller failure.

Figure 1:
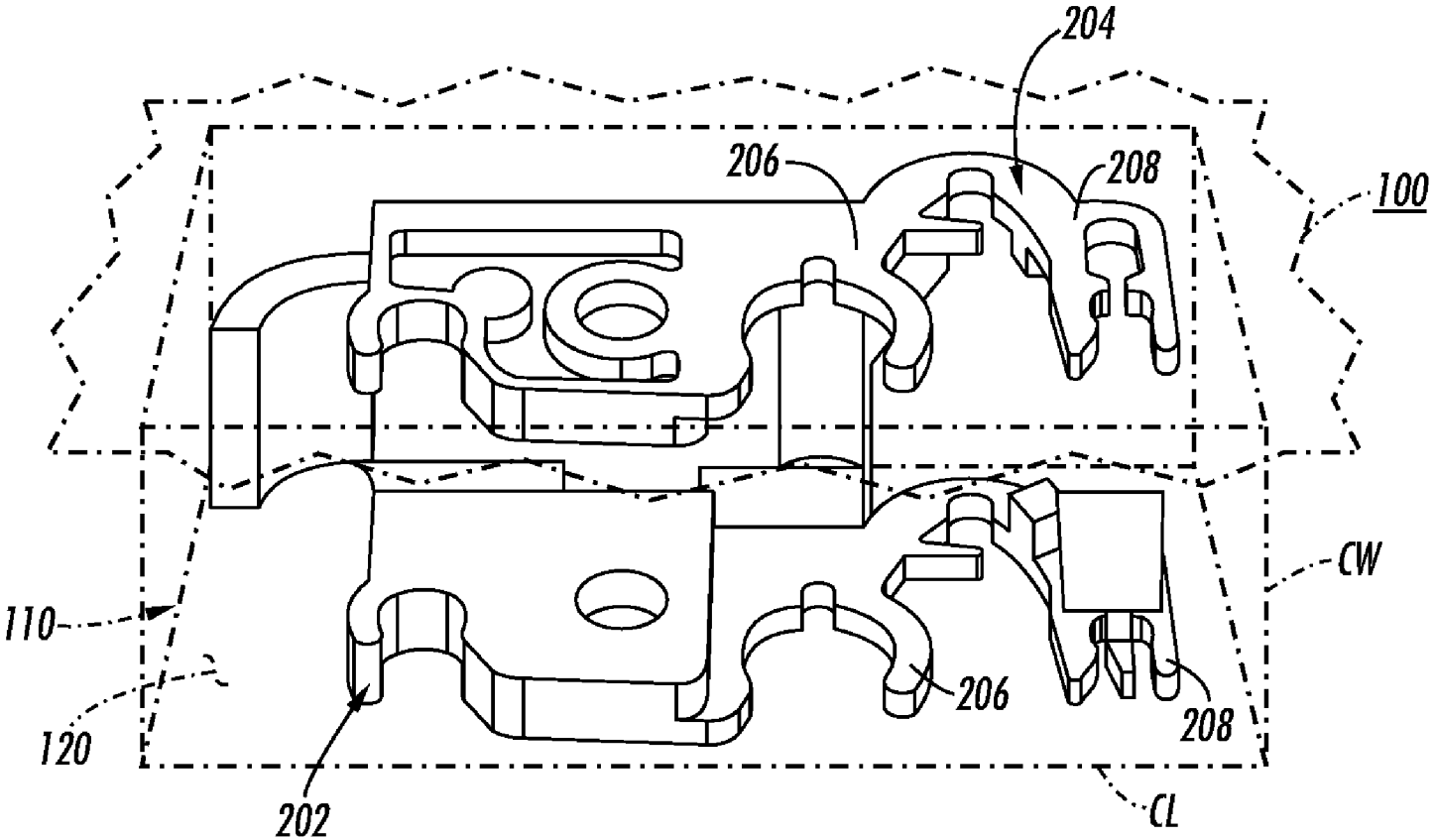
FIG. 1 is a perspective illustration of a portion of a sheet handling machine including an assembled sheet feeding nip assembly or CRU in accordance with the present disclosure.
Figure 2:
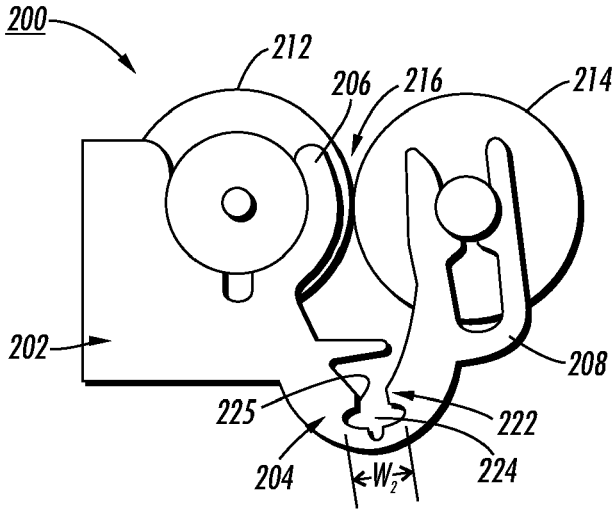
FIG. 2 is an illustration of a frame portion of the sheet feeding nip assembly showing the distendable recess therein and the two sheet feeding rolls thereof in contact.

Referring now to FIG. 1, the customer replaceable Unit (CRU) frame 202 for a sheet feeding nip assembly is shown mounted (without the nip forming rollers thereto) within a cavity 120 of a portion 110 of a sheet handling machine 100. The machine for example can be an electrostatographic reproduction machine, and the sheet feeding assembly can be a CRU such as a small document feeder. The fit of the CRU frame 202 within the cavity 120 is such that even with the nip forming rollers assembled thereto, the sheet feeding assembly will operate within such portion without interference with any other adjacent machine components. As illustrated in FIG. 2, the CRU frame 202 is designed such that when the sheet feeding rollers 212, 214 are assembled thereto, the one roller is in contact with the other to form a sheet feeding nip 216.

Referring now to all the FIGS. 1-5, details of the sheet feeding assembly such as the customer replaceable unit (CRU) assembly 200 of the present disclosure are illustrated. The CRU assembly 200 as such is suitable for mounting into the mounting portion 110 of a sheet handling machine 100. As disclosed, the CRU assembly 200 includes (a) the CRU frame 202 having a frame size CW (which as shown is the width dimension of the cavity 120 whose length dimension is shown as CL) for fitting into the mounting portion 110 within the sheet handling machine; (b) a first roller 212 assembled rotatably to the CRU frame; (c) a second roller 214 assembled rotatably to the CRU frame and for resilient contact with the first roller 212 to form the sheet handling nip 216; and (d) a spacer and anti-mounting assembly 220 including (i) a holding means 222 formed in the CRU frame 202 on each side of the width thereof and (ii) a removable member 230 mounted in the holding means 222 for temporarily preventing mounting of the CRU frame 202 into the mounting portion 110 within the sheet handling machine 100, and for temporarily spacing the second roller 214 out of resilient contact with the first roller 212 so as to prevent roller flat spots, operating roller noise, and premature roller failure.

The CRU frame 202 includes the forked member 204 having the first set of hands 206 for supporting the first roller 212 and a second set of hands 208 for supporting the second roller 214. As illustrated clearly in FIGS. 2-3B, the second set of hands 208 is located opposite to, and resiliently spaced from, the first set of hands 206.

Figure 3A:
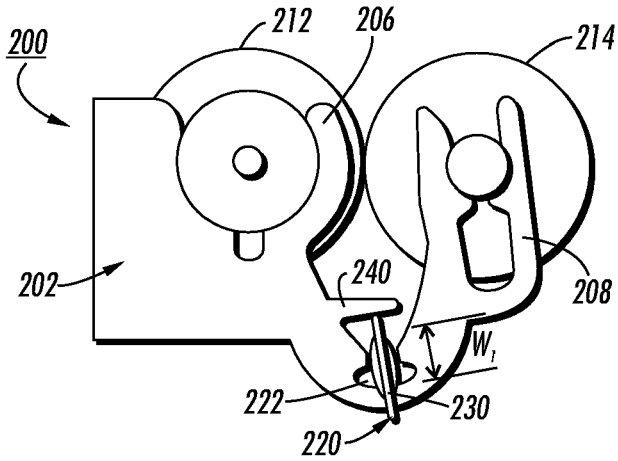
FIG. 3A is an illustration of the frame portion of the sheet feeding nip assembly of FIG. 2 showing the removable member within the distendable recess in an unloaded orientation and the two sheet feeding rolls thereof still in contact.
Figure 3B:
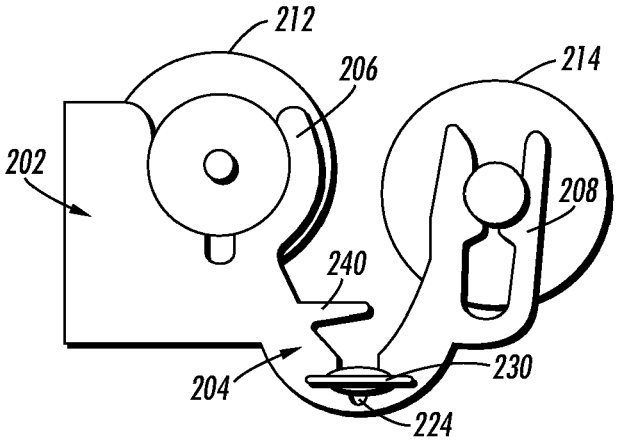
FIG. 3B is an illustration of the frame portion of the sheet feeding nip assembly of FIG. 2 showing the removable member within the distendable recess in a loaded orientation and the two sheet feeding rolls thereof out of contact
Figure 4A:
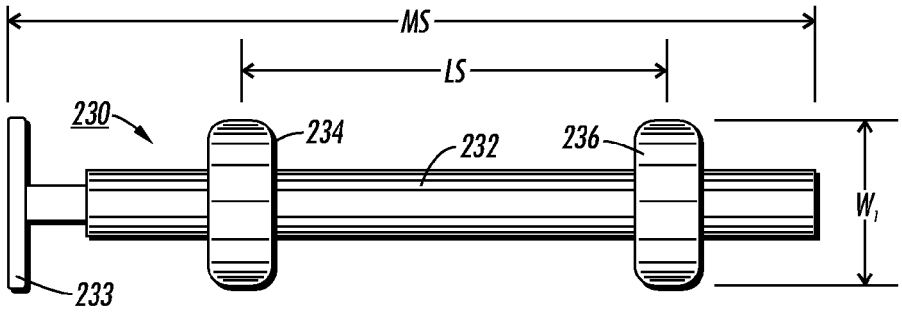
FIG. 4A is a side view, and 4B is an end view, of the removable cam member for use as in FIGS. 3A and 3B.
Figure 4B:
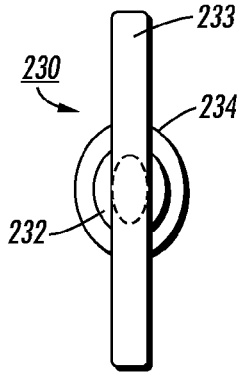
Figure 5:
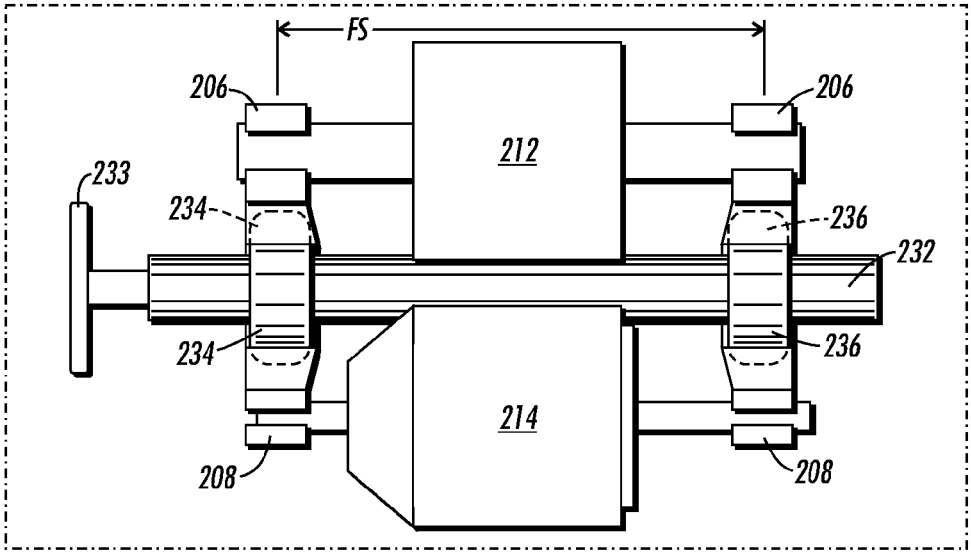
FIG. 5 is a top view of FIG. 3B.

The removable member 230 has a member size MS (FIG. 4A) that is significantly greater than the frame size CW (FIG. 1). As shown, the removable member 230 can be an elongate shaft cam device comprising a shaft portion 232 that has a crank handle 233 at least at one end for handling and manual manipulation thereof, as well as two sets of cam tabs 234, 236, the centers of which are spaced a distance LS longitudinally on the shaft portion. The distance LS as shown in FIG. 4A is the same as a distance FS between the two hands in the set of hands 206 as well as that between the hands in the set of hands 208 so as to fit and work cooperatively within the distendable recess 224 on each side of the width of the frame 202, and the edge 225 of the distendable recess 224 comprise a cam follower surface along which the surface of the cam tabs 234, 236 ride when being moved from the vertical orientation (FIG. 3A) to the horizontal orientation (FIG. 3B).

The holding means 222 comprise a distendable recess 224 on each side of the width of the frame 202 that is formed in a forked member 204 of the CRU frame between a hand 206 (of first set of hands) and a hand 208 (of the second set of hands). The distendable recess 224 for example may have a generally upside down cross-shape cross-section as shown in FIG. 2. The width W2 of the arms of the cross-shape by design is made significantly less than W1 the span of the first and second cam tabs of each set of cam tabs 234, 236 as shown in FIGS. 3A and 4A. This significant difference between the dimensions W1 and W2 is what allows the cam tabs 234, 236, when rotated from the vertical free orientation of FIG. 3A to the loaded horizontal orientation of FIG. 3B, to distend the recess 224, thereby causing the hand 208 to be spaced from the hand 206, and the second roller 214 to be equally spaced from the first roller 212 (FIG. 3B). It should also be noted that the removable member 230 with the cam tabs 234, 236, instead of being rotated from a vertical to horizontal orientation as described, could merely be inserted directly in the horizontal orientation and would achieve exactly the same result.

The present disclosure thus is directed to a CRU assembly that includes a specially designed spacer and anti-mounting assembly 220. The anti-mounting assembly 220 includes a disposable, removable member 230 such as a shaft cam device, that when assembled into a distendable feature of the CRU frame, alters or bends the frame of the CRU outwardly so as to separate and prevent the first and second rollers 212, 214, from contacting each other.

The removable member 230 can be made of a plastic or other suitable material. The spacer and anti-mounting assembly 220 including the disposable, removable member 230 will be assembled for such use along with other CRU spares during shipping and storage of the CRU assembly 200, and will be removed, disassembled or modified at the customer site before mounting of the CRU assembly 200 into the sheet handling machine 100. The spacer and anti-mounting assembly 220 is such that when the disposable removable member 230 is removed, disassembled or modified as above, the sheet feeding nip assembly or CRU frame 202 and the retard and feed rollers 212, 214 will return to their manufactured or nip forming starting geometry that has substantially its critical operating dimensions and specifications that are free of clearance and interference issues with other related machine components.

The spacer and anti-mounting assembly 220 is designed so that the customer can easily remove or alter the removable member 230 from the sheet feeding nip assembly or CRU assembly 200 without interfering with either of the first and the second rollers 212, 214. As pointed out above, the member size MS of the removable member 230 is significantly greater than the width CW of the cavity 120, such that the CRU assembly 200 cannot be installed or mounted into its intended portion within the sheet handling machine without first disassembling or removing the removable member 230 from the CRU or CRU assembly. The member size MS for example is a length of the shaft cam device 230 as shown in FIG. 4A. The CRU frame 202 may additionally include a protective finger 240 for protecting the first roller 212 during removal of the removable member from the CRU frame 202.

As described above, the removable member 230 is a shaft cam device that includes two sets of tabs 234, 236 that can be moved from a free and unloaded vertical orientation (FIG. 3A), to a loaded horizontal orientation (FIG. 3B) in order to distend each recess 224 (one on each side of the frame 202) and hence space the first set of hands 206 and the first roller 212 from the second set of hands 208 and the second roller 214. The overall width W1 of each set of tabs 234, 236 is significantly greater than the free horizontal dimension W2 of each distendable recess 224. The distendable recess 224 of course will a loaded or distended dimension of W1 when the shaft cam device 230 is rotated from the vertical position (FIG. 3A) into the loaded horizontal position of (FIG. 3B).

As can be seen, there has been provided a customer replaceable unit (CRU) assembly for mounting in a sheet handling machine is disclosed and includes (a) a CRU frame having a frame size for fitting into a mounting portion within the sheet handling machine; (b) a first roller assembled rotatably to the CRU frame; (c) a second roller assembled rotatably to the CRU frame and for resilient contact with the first roller to form a sheet handling nip; and (d) a spacer and anti-mounting assembly including (i) a holding means formed in the CRU frame and (ii) a removable member mounted in the holding means for temporarily preventing mounting of the CRU frame into the mounting portion within the sheet handling machine, and for temporarily spacing the second roller out of resilient contact with the first roller so as to prevent roller flat spots, operating roller noise, and premature roller failure.

It will be appreciated that various adaptations of the above-disclosed and other features and functions of this embodiment, or alternatives thereof, may be desirably combined into other different systems or applications. Therefore, unless specifically defined in a specific claim itself, steps or components of the invention should not be implied or imported from any above example as limitations to any particular order, number, position, size, shape, angle, color, or material. Additionally, it be appreciated that various presently unforeseen or unanticipated alternatives, modifications, variations or improvements therein may be subsequently made by those skilled in the art which are also intended to be encompassed by the following claims.

What is claimed is:

1. A customer replaceable unit (CRU) assembly for mounting in a sheet handling machine, the CRU assembly comprising:

(a) a CRU frame having a frame size for fitting into a mounting portion within the sheet handling machine, said CRU frame including a forked member having a first set of hands for supporting said first roller and a second set of hands for supporting said second roller;

(b) a first roller assembled rotatably to said CRU frame;

(c) a second roller assembled rotatably to said CRU frame and for resilient contact with said first roller to form a sheet handling nip; and (d) a spacer and anti-mounting assembly including (i) a holding means formed in said CRU frame and (ii) a removable member mounted in said holding means for temporarily preventing mounting of said CRU frame into said mounting portion within the sheet handling machine, and for temporarily spacing said second roller out of resilient contact with said first roller so as to prevent roller flat spots, operating roller noise, and premature roller failure.

2. The CRU assembly of claim 1, wherein said removable member has a member size significantly greater than said frame size.

3. The CRU assembly of claim 1, wherein said removable member comprises an elongate shaft cam device.

4. The CRU assembly of claim 3, wherein edges of said shaft cam device includes a pair of cam tabs spaced longitudinally thereon for cooperating with said holding means on said CRU frame.

5. The CRU assembly of claim 3, wherein said member size comprises a longitudinal length of said shaft cam device.

6. The CRU assembly of claim 1, wherein said removable member includes a crank handle to at least one end thereof.

7. The CRU assembly of claim 1, wherein said holding means comprises a distendable recess formed in said forked member between said first set of hands and said second set of hands.

8. The CRU assembly of claim 7, wherein said distendable recess has a free unloaded horizontal dimension significantly less than a width of a set of tabs on said shaft cam device.

9. The CRU assembly of claim 7, wherein said distendable recess has a generally upside down cross-shape cross-section.

10. The CRU assembly of claim 7, wherein said distendable recess has a loaded horizontal dimension greater than an unloaded horizontal dimension thereof and equal to a width of a set of tabs on said shaft cam device.

11. The CRU assembly of claim 1, wherein said second set of hands is located opposite to, and resiliently spaced from, said first set of hands.

12. The CRU assembly of claim 1, wherein said forked member includes a finger portion spaced from and extending over said holding means for protecting said first roller and said second roller from said removable member.

* * * * *